United States Patent [19]

Nakazato et al.

[11] 4,001,052

[45] Jan. 4, 1977

[54] HOT-ROLLED LOW-CARBON STEEL STRIP WITH AN EXCELLENT PRESS-WORKABILITY CAPABLE OF FORMING SMOOTH PRESSED SURFACE AND A METHOD OF MAKING THE SAME

[75] Inventors: Yoshio Nakazato; Masatoshi Nakazawa; Nobuo Ohashi; Yo Ito, all of Chiba, Japan

[73] Assignee: Kawasaki Steel Corporation, Kobe, Japan

[22] Filed: Nov. 13, 1974

[21] Appl. No.: 523,537

Related U.S. Application Data

[63] Continuation-in-part of Ser. No. 290,393, Sept. 19, 1972, abandoned.

[30] Foreign Application Priority Data

Sept. 30, 1971 Japan ..... 46-75795

[52] U.S. Cl. ..... 148/12 C; 75/123 B; 148/36

[51] Int. Cl.[2] ..... C21D 9/48; C22C 38/00

[58] Field of Search ..... 75/123 R, 123 B; 148/36, 12 C

[56] References Cited

UNITED STATES PATENTS

| | | | |
|---|---|---|---|
| 2,357,876 | 9/1944 | Crafts et al. | 75/123 B |
| 2,771,651 | 11/1956 | Morgan et al. | 75/123 B |
| 2,772,154 | 11/1956 | Morgan et al. | 75/123 B |
| 2,999,749 | 9/1961 | Saunders et al. | 75/58 |
| 3,716,420 | 2/1973 | Matsudo et al. | 148/12 C |
| 3,725,143 | 4/1973 | Alworth et al. | 75/123 B |

*Primary Examiner*—W. Stallard
*Attorney, Agent, or Firm*—Fleit & Jacobson

[57] ABSTRACT

Hot-rolled low-carbon steel strip with an excellent press-workability capable of forming a smooth pressed surface consisting essentially of up to 0.12 wt. % carbon, up to 0.01 wt. % nitrogen, up to 0.0094 wt. % boron, and other specific optional ingredients, the B(%)/N(%) ratio being 0.3 to 0.94. The micrograin size number, JIS, of ferrite in the steel strip as hot-rolled is 7 to 9. The steel strip is made by hot-rolling while controlling the temperatures at the entry and delivery ends of a hot-strip finishing mill.

17 Claims, 9 Drawing Figures o--Specimen A1-5, invention
x--Specimen A6-9, Aℓ-killed steel, reference
Δ--Specimen A10,11, Aℓ-Ti-killed steel, reference
•--Specimen B1-7, rimmed steel, reference
JIS Micro-Grain Size Number
10.0
9.0
8.0
7.0
550
600
650
700
Coiling Temperature(°C)

o--Steel of invention
x--B-containing steel, reference
JIS Micro-Grain Size Number
10.0
9.0
8.0
7.0
950
1000
1050
Hot Strip Finishing Mill Entry End Temperature(°C)

Magnification x 100

HOT-ROLLED LOW-CARBON STEEL STRIP WITH AN EXCELLENT PRESS-WORKABILITY CAPABLE OF FORMING SMOOTH PRESSED SURFACE AND A METHOD OF MAKING THE SAME

CROSS-REFERENCE TO RELATED APPLICATION

This application is a continuation-in-part of application Ser. No. 290,393, filed Sept. 19, 1972, and now abandoned.

This invention relates to a hot-rolled low-carbon steel steel strip with an excellent press-workability which is capable of forming a smooth pressed surface, the pressed surface being particularly suitable for succeeding treatment, e.g., plating and painting, and a method of making the hot-rolled low-carbon steel strip.

The present invention also relates to a hot-rolled steel strip having both high drawability and high stretch-flangeability at sheared edge surface.

To use steel strip to make outer coverings, or exposed accessaries, it is often pressed and its surface is coated, e.g., by metal plating or painting. To facilitate the pressing and coating, cold-rolled steel strip is generally used. Hot-rolled steel strip is used only when the required thickness of steel strip, or plate, does not allow the cold-rolling. The use of hot-rolled steel strip, however, involves inherent difficulties which are not experienced with cold-rolled steel strip. The difficulties with the hot-rolled steel strip will be described by using an example of manufacturing a car bumper.

Materials for car bumpers are required to have high press-workability, as can be seen from different pressing operations involved in the process of manufacturing automobiles. If pressing work causes stretcher strain in the steel strip, the stretcher strain must be removed in the step of polishing prior to metal plating. To prevent the stretcher strain, a step of temper rolling is necessary for eliminating the yield elongation of hot-rolled steel strip.

To apply metal plating on pressed steel strip, its surface must be smooth. The surface of hot-rolled steel strip is polished for this purpose after removing scales by pickling or shot-blasting. It is preferable to effect the surface polishing on flat steel strip or plate rather than on pressed surfaces thereof because the polishing can be effected more efficiently and more easily on flat surfaces than on curved surfaces. The pressing of hot-rolled steel strips, however, tends to cause defective surface conditions which are detrimental to metal plating. The cause for the generation of the defective surface conditions by pressing is the so-called "fine coil break" of the steel strip. The expression "fine coil break" refers to transverse kinks developed during the straightening of hot-rolled or annealed coils of strip which has resulted in the extension of the inside surface length beyond the elastic limit. The fine coil break is caused by coiling and recoiling of the steel strip for pickling, shot-blasting, and temper rolling. Such fine coil break is virtually eliminated by temper rolling, but it become apparent again as uneven surface undulation upon application of pressing on the steel strip. Thus, hot-rolled steel strip having latent fine coil break is not suitable for making car bumpers or other exposed members.

Accordingly, there are three conditions which are required for hot-rolled steel strips to be used as materials of outer coverings, or exposed accesaries; namely, (1) high press-workability, (2) freedom from stretcher strain, and (3) freedom from latent fine coil break, or localized plastic deformation.

It has been very difficult to simultaneously meet the aforesaid three conditions with a single hot-rolled steel strip, although one or two of the requirements may be separately satisfied by different hot-rolled steel strips. The detailed reasons for the difficulty of simultaneously meeting them will be discussed later.

Therefore, an object of the present invention is to provide hot-rolled steel strip which can simultaneously meet the aforesaid three conditions. Another object of the present invention is to provide a method of making such hot-rolled steel strip.

According to the present invention, there is provided a hot-rolled low-carbon steel strip with excellent press-workability capable of forming a smooth pressed surface consisting essentially of up to 0.12% by weight of carbon, up to 0.01% by weight of nitrogen, and up to 0.01% by weight of boron, the ratio of the boron content in percent by weight to the nitrogen content in percent by weight being 0.3 to 0.94 and the micro-grain size number, JIS, ferrite in the steel strip being 7 to 9. The expression "ferrite grain size" means the micro-grain size number (N), as defined by JIS (Japanese Industrial Standard) G 0552 by the following formula:

$$2^{N-1} = n$$

where $n$ represents the number of grains as counted in the 25 mm by 25 mm square of a microscopic photograph with a magnification of 100 times.

For a better understanding of the invention, reference is made to the accompanying drawing, in which.

Before discussing the details of the steel strip of the present invention, a brief review will be made of the reasons why it is difficult to provide a hot-rolled low-carbon steel strip which simultaneously fulfills the aforesaid three requirements; namely, (1) high press-workability, (2) freedom from stretcher strain, and (3) freedom from latent fine coil break.

Of the three requirements, the fine coil break phenomenon can be most easily avoided by cooling the hot-rolled steel strip to a suitable temperature before coiling it. The critical coiling temperature for preventing the fine coil break phenomenon may vary somewhat depending on the radius of curvature of the coiling and the material of the steel strip, but the fundamental problems of fine coil break are solved by cooling before coiling.

As regards the second requirement of stretcher strain, there are two causes. First, yield elongation of steel strip may be initially eliminated by temper rolling, but age-hardening will cause the initially eliminated yield elongation to become apparent again as stretcher strain. Second, if the yield elongation cannot be removed completely by the temper rolling, the residual yield elongation will also become stretcher strain. There are two approaches to the solution of the stretcher strain problem corresponding to these two factors. The knowledge of cold-rolled steel strip is applicable to the removal of stretcher strain due to the first factor; namely, it is known that pressing after temper rolling and before age-hardening occurs is effective in preventing the stretcher strain, and the addition of a nitrogen-fixing element such as zirconium, titanium, aluminum, tantalum, vanadium, boron, etc., will make the steel non-aging and prevent the occurrence of stretcher strain. As regards the second factor, the micro-grain size of ferrite of steel strip is a direct cause of the incomplete removal of yield elongation. More particularly, the yield elongation of the steel strip before temper rolling is intrinsically related to its ferrite grain size, the yield elongation becoming smaller as the ferrite grain size becomes smaller (i.e., as the mean diameter of ferrite grains becomes larger). Smaller yield elongation of steel strip means that the reduction rate of temper rolling necessary for eliminating the stretcher strain becomes smaller.

Figure 1A:
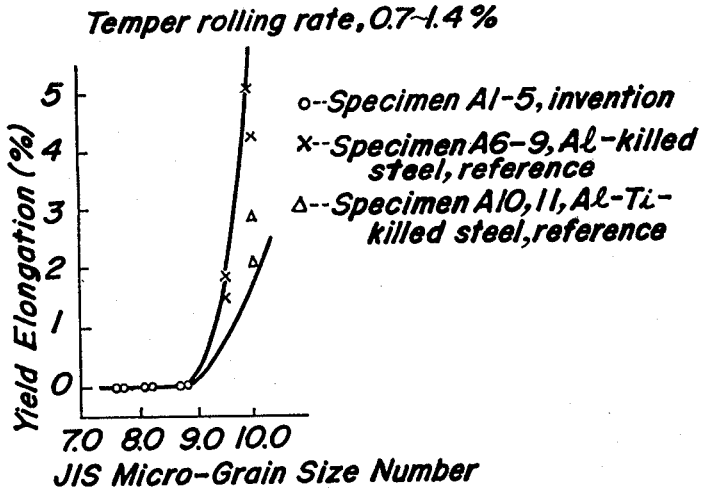
FIGS. 1A and 1B are diagrams showing the relation between the micro-grain size of ferrite in steel strip and its residual yield elongation after temper rolling at a rolling rate of 0.7% to 1.4% and 1.5% to 3.0%, respectively.
Figure 1B:
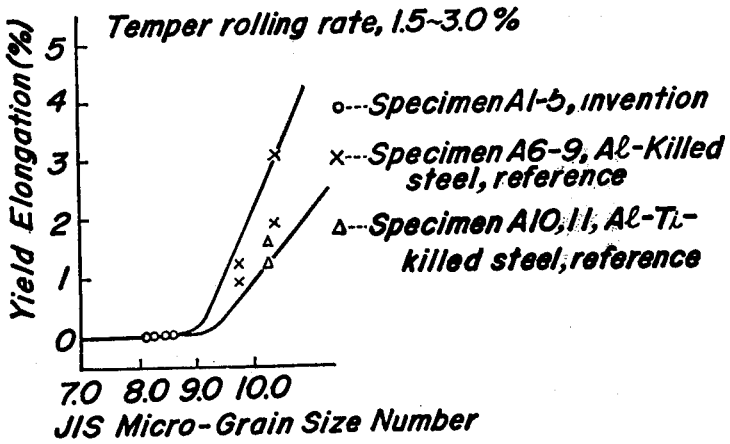

FIGS. 1A and 1B illustrate the relationship between the ferrite grain size number, JIS, of 2.3 mm thick steel strips and their residual percent yield elongation after temper rolling. It is apparent from these figures that with steel strips consisting of fine grains (having a ferrite grain size number of greater than 9), stretcher strain cannot be removed by the commonly used reduction rate of temper rolling which is about 1%. In other words, since steel strip having a fine grain size must be subjected to a comparatively high reduction rate of temper rolling for eliminating stretcher strain, its ductility is greatly reduced. Thus, in order to simultaneously meet the requirements of (1) high workability and (2) freedom from stretcher strain, the crystal grain size of the steel strip must be adjusted to a certain range regardless of whether it is hot-rolled or cold-rolled.

The grain size of steel strip directly affects its press-workability. That is, a fine grain steel has a high yield strength/tensile strength ratio and its press-workability is poor, while excessively large grains of steel tend to result in a rough surface called "orange peel" upon pressing. It is well known in the art that the most suitable ferrite grain size of steel for pressing is about No. 8. The ferrite grain size of cold-rolled steel strip can be adjusted comparatively easily, because the process of manufacturing it includes annealing. Such grain size adjustment is not generally available in hot-rolled steel strip. It is, of course, known in the art to anneal hot-rolled steel strip for improving its press-workability, but this means an extra step in the manufacturing process and results in increased manufacturing cost.

Figure 2:
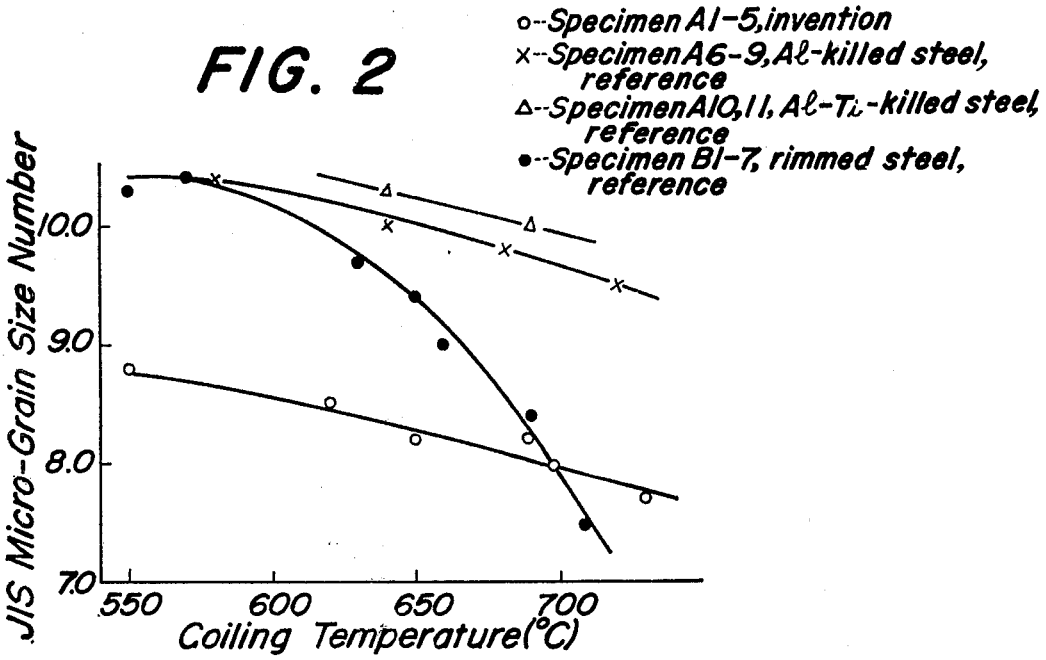
FIG. 2 is a diagram showing the relation between coiling temperature of hot-rolled steel strip and micro-grain size number of ferrite therein after the coiling.

To mitigate such difficulty, the control of ferrite grain size of hot-rolled steel strip is sometimes effected by regulating the temperature when coiling it during hot-rolling. FIG. 2 illustrates the relation between the coiling temperature and the ferrite grain size of ferrite for various hot-rolled low-carbon steel strips. As the coiling temperature becomes higher, the self-annealing effect of the steel strip after the coiling increases and its ferrite grain size tends to become larger as can be seen from FIG. 2. Such tendency of forming large ferrite grain size at higher coiling temperature is apparent in low-carbon rimmed steel having no nitrogen-fixing element. In the case of killed steel having a nitrogen-fixing element, such as aluminum or titanium, precipitated nitrides tend to disturb grain boundary migration, so that ferrite grains hardly grow during annealing. Therefore, it is generally difficult to provide hot-rolled steel strip having a ferrite grain size number 8 or so by elevating the coiling temperature alone, unless special hot-rolling conditions are used.

Elevating the coiling temperature is effective in making large grains, and it appears to improve the press-workability of the steel strip. The high coiling temperature, however, tends to increase the size of precipitated carbide grains, and large carbides are detrimental to the press-workability of steel strip.

More particularly, it is well known that carbides, which exist in the structure of hot-rolled low-carbon steel strip, act as the source of cracks in ductile fracture and that the greater the carbides are the greater is the deterioration of the steel strip.

Thus, the conventional method of controlling ferrite grain size by regulating the coiling temperature involves certain drawbacks. Moreover, this method is contrary to prevention of the fine coil break phenomenon.

Due to the aforesaid reasons, it has been impossible to simultaneously meet the three conditions required for hot-rolled low-carbon steel strip which is to be used for making outer coverings and exposed accessaries.

The inventors have steadily and elaborately carried out studies on means for solving the aforesaid difficulties. As a result, the inventors have succeeded in producing hot-rolled low-carbon steel strip coil which is substantially free from the fine coil break phenomenon in uncoiling and has a ferrite grain size number of 7 to 9. The hot-rolled low-carbon steel strip coil is made by regulating the rolling conditions in the hot-strip mill and by adding a suitable amount of boron in the molten steel while regulating the contents of carbon and nitrogen therein.

The hot-rolled low-carbon steel strip coil can be processed to the final product by temper rolling at a reduction rate which is harmless to its press-workability, removing scales from the surface, polishing the surface and pressing. The excellent press-workability of the steel strip of the invention minimizes scrap rate in pressing and produces pressed goods which are free from fine coil break, roughened surfaces, and stretcher strain, as well as from other undesirable surface irregularities. Accordingly, the pressed goods are ready for succeeding treatments, such as metal plating and painting. Even if minor die scratches are caused, they can easily be removed, for instance, by simple polishing.

One of the essential features of the present invention lies in adding boron to the steel manufacturing process. Conventionally, boron has been added for improving the hardenability of steel or for making the steel non-aging by fixing nitrogen. In the present invention, boron is added for adjusting the ferrite grain size number of the hot-rolled low-carbon steel strip to a level of 7 to 9, by using the special bearing of boron on the rolling of steel slab in the hot-strip rolling in heated austenite phase and its recrystallization, the succeeding transformation, and the growth of grains in the ferrite phase thereafter.

It is an important finding of the inventors that this special effect of boron cannot be fully achieved by merely selecting the proper quantity of boron itself, but contents of carbon and nitrogen must be coordinated with the amount of boron while considering the hot-rolling conditions.

The scope of the invention is limited to steel strip which is continuously hot-rolled in a hot-strip mill, because the aforesaid special effect of boron can be achieved only when certain temperature-time relations in hot-rolling are fulfilled, provided that the contents of carbon and nitrogen are regulated during the hot-rolling as will be described hereinafter.

With the present invention, the carbon content is restricted to up to 0.12 wt. % and the nitrogen content is restricted to be up to 0.01 wt. %. The reason for this restriction of the contents of carbon and nitrogen is not merely the fact that such low contents of carbon and nitrogen result in an excellent press-workability, but in the very fact that the presence of carbon and nitrogen in excess of the aforesaid range greatly reduces the effect of boron in making large ferrite grains. If large ferrite grains should are not obtained, the object of the invention of achieving a ferrite grain size number of not greater than 9 fails.

The exact mechanism by which the presence of carbon and nitrogen in excess of the given range disturbs the effect of boron in making large ferrite grains during hot-rolling is not yet known. Roughly speaking, the strong interaction between boron and carbon, or nitrogen, in steel has a bearing on the detrimental action on the effect of boron.

Thus, the absolute content of boron must be 0.01 wt. % or less and its content relative to nitrogen, namely, the B(%)/N(%) ratio, must be 0.3 to 0.94. Unless those two conditions of boron content are satisfied, the desired hot-rolled low-carbon steel strip having a ferrite grain size number of not greater than 9 cannot be achieved.

The present invention is apparently different from a conventional art of adding boron for improving the non-aging property of steel because the object of the present invention can be achieved with a boron content lower than a stoichiometrical B/N ratio which is necessary for fixing nitrogen, namely, B/N=0.86.

With the present invention, it is also possible to achieve perfect non-aging property while using elements which have a larger affinity to nitrogen than to boron. As known in the art, these elements tend to reduce the ferrite grain size. For instance, aluminum-killed steel has a smaller grain size than rimmed steel, and titanium-killed steel has still further smaller grain size, as shown in FIG. 2. Therefore, due care must be taken of the fact that if these elements are used excessively, the desired ferrite grain size number of not greater than 9 cannot be achieved even when boron is added in the aforesaid amount.

In hot-rolling the steel strip of the invention, the delivery or outlet end of a finishing mill must be kept above the transformation temperature of the steel but below a maximum coiling temperature for preventing fine coil break. If the hot-rolling is effected at a temperature in which the ferrite phase is contained, mixed grain size is formed, which may lead to a rough surface.

Figure 3:
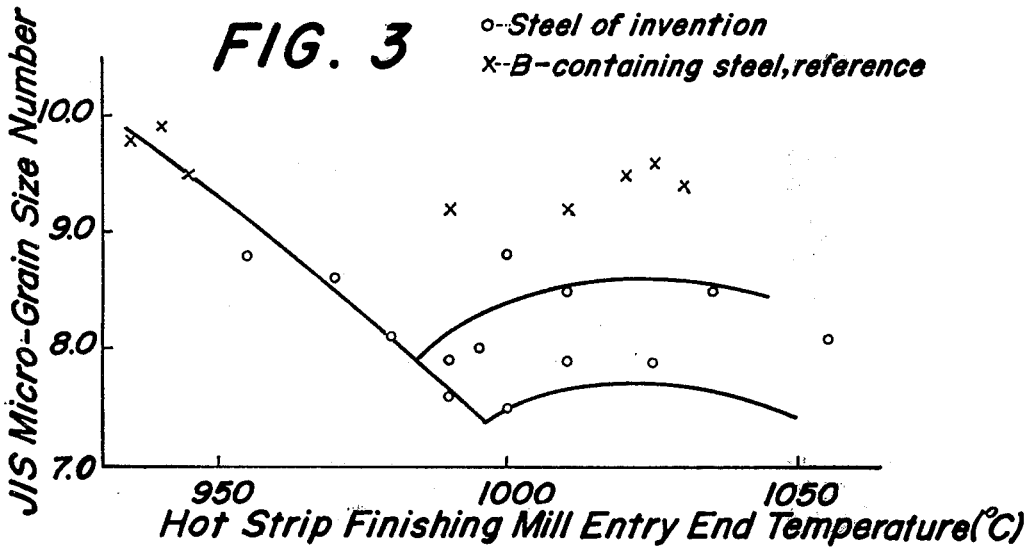
FIG. 3 is a diagram showing the relation between the micro-grain size and finishing mill entry end temperature.

As shown in FIG. 3, if the temperature of the entry or inlet end of the finishing mill is below 950° C, the desired effect of boron is completely lost.

There are no strict requirements on other rolling conditions. Qualitatively speaking, a better effect can be achieved by using a higher slab temperature, a higher temperature at the delivery end of the finishing mill, and a slower cooling on the hot run table.

Other related conditions in working the present invention will now be described. Manganese may be used to prevent hot shortness due to the presence of sulfur in steel. To this end, the condition of Mn/S>10 must be fulfilled. For hot-rolled soft steel plate for pressing, the content of manganese is restricted to less than 1.20 wt.%.

Other alloying ingredients may be added, unless they are detrimental to the press-workability of the steel strip and to the effect of boron in making large grains. More particularly, as a deoxidizer, up to 0.5 wt.% silicon, up to 0.1 wt.% aluminum, up to 0.05 wt.% titanium, and/or 0.05 wt.% zirconium may be used. As regards niobium and vanadium, the addition of such elements may improve the non-aging property of the steel by fixing nitrogen, but the presence of niobium and/or vanadium tends to excessively harden the steel by forming carbides. Thus, niobium and vanadium are detrimental to the press-workability of the steel so that, even when they are used as deoxidizers, they should not be left in the steel in the form of a solid solution. The content of phosphorus and sulfur should be low for keeping high press-workability; namely, up to 0.03 wt.% phosphorus and up to 0.03 wt.% sulfur.

To keep the nitrogen content in the steel strip according to the present invention below the aforesaid upper limit, the use of an electric furnace is not desirable, although conventional boron-containing steels are treated by electric furnaces. It is preferable to melt the steel of the invention by a converter.

Since boron has a strong affinity with oxygen, there is a technical problem in adjusting the alloy composition in the case of rimmed steel. It is preferable to melt the steel in the form of semi-killed steel or killed-steel.

As can be seen from the nature of the steel according to the present invention, it can be worked either by ingot casting or by continuous slab casting.

The invention will now be described in further detail by referring to the examples.

EXAMPLE 1

Steels having the compositions at ladle as shown in Table 1 were melted in an oxygen top-blown converter and 0.005 wt.% boron was added by using ferro-boron when pouring into an ingot cast. Thus, three ingot Specimens A-1 to A-3 were made.

The ingot Specimens A-1 to A-3 were separately rolled into 230 mm thick slabs, and further rolled in a hot-strip mill into 2.3 mm thick steel strips under the conditions of slab temperature of 1,280° C, finishing mill entry end temperature of 1.070° to 980° C, and finishing mill delivery and temperature of 870° to 845° C.

The steel strips were coiled as a coil with an inside diameter of 762 mm, while keeping the coiling temperature in a range of 550° to 730° C by regulating the water quantity at the hot run table during the rolling.

The ferrite grain size of the hot-rolled steel strip thus prepared was measured, by the method as stipulated in Japanese Industrial Standard JIS G 0552. The relation between the coiling temperature and the ferrite grain size thus determined is shown in FIG. 2. FIG. 2 also shows similar results for reference steels of Table 1; namely, aluminum-killed steel Specimens (A-4 to A-7) and aluminum-titanium-killed steel Specimens (A-8 to A-9) which were made by adding 0.02 wt.% titanium at the casting die; as well as for typical low-carbon rimmed steel Specimens (B-1 to B-7) of Table 2. The reference steel Specimens A-4 to A-9 and the low-carbon rimmed steel Specimens B-1 to B-7 were rolled in the hot-strip mill, in the same manner as the steel strip Specimens A-1 to A-3.

Each of the hot-rolled coils were subjected to temper rolling, while partially varying the degree of rolling from 0.7% to 2.7%. FIGS. 1A and 1B show the relation among the degree of temper rolling, the ferrite grain size, and residual percent yield elongation.

The surfaces of the Specimens A-1 to A-9 were polished while they were flat, and pressed into rear bumpers for large passenger cars. The scrap rates and the appearance of the Specimens thus pressed are shown in Table 1.

Table 1(a)

| Specimen No. | | Composition, at ladle (Wt. %) Carbon | Manganese | Phosphorus | Sulfur | Aluminum | Boron* (B) | Nitrogen* (N) | B/N | Titanium* |
|---|---|---|---|---|---|---|---|---|---|---|
| A-1 | Invention | 0.037 | 0.25 | 0.008 | 0.013 | 0.051 | 0.0046 | 0.0051 | 0.90 | — |
| A-2 | | | | | | | 0.0048 | 0.0053 | 0.91 | — |
| A-3 | | | | | | | 0.0047 | 0.0050 | 0.94 | — |
| A-4 | Aluminum-killed steel, Reference | | | | | | — | 0.0046 | — | — |
| A-5 | | | | | | | — | 0.0049 | — | — |
| A-6 | | | | | | | — | 0.0051 | — | — |
| A-7 | | | | | | | — | 0.0058 | — | — |
| A-8 | Aluminum-titanium-killed steel, Reference | | | | | | — | 0.0052 | — | 0.017 |
| A-9 | | | | | | | — | 0.0047 | — | 0.020 |

*Boron, nitrogen, and titanium were added in a casting die, and their contents were determined by bomb sampling from the die.

Table 1(b)

| Specimen No. | | Coiling temperature (° C) | JIS, Micro-grain size No. | Rate of temper rolling (%) | ** Yield elongation (%) | Result of pressing for making car bumper: Press cracking | *** Stretcher strain | *** Kink mark |
|---|---|---|---|---|---|---|---|---|
| A-1 | Invention | 550 | 8.8 | 0.9–1.2 | 0, 0 | 0/442 | A | A |
| A-2 | | 650 | 8.2 | 1.8–2.0 | 0, 0 | 0/438 | A | A |
| A-3 | | 690 | 8.2 | 1.1–1.3 | 0, 0 | 0/414 | A | B |
| A-4 | Aluminum-killed steel, Reference | 580 | 10.4 | 2.3–2.7 | 1.9, 3.1 | 8/8 | — | — |
| A-5 | | 640 | 10.0 | 0.9–1.3 | 4.3, 5.1 | 3/46 | C | A |
| A-6 | | 680 | 9.8 | 1.8–2.0 | 0.9, 1.2 | 31/266 | B | B |
| A-7 | | 720 | 9.5 | 1.1–1.3 | 1.5, 1.9 | 7/106 | B | C |
| A-8 | Aluminum-titanium-killed steel, Reference | 640 | 10.3 | 1.8–2.0 | 1.2, 1.6 | 11/16 | B | A |
| A-9 | | 690 | 10.0 | 1.0–1.3 | 2.1, 2.9 | — | — | — |

** Samples were taken from two locations of each coil, and the percent yield elongation was measured by using a cross-direction sample.
*** A: Not found,
B: Could be reused after re-polishing,
C: Not usable.

Table 2

| Specimen No. | | Composition at ladle (Wt. %) Carbon | Manganese | Phosphorus | Sulfur | Coiling temperature (° C) | JIS, Micro-grain size No. |
|---|---|---|---|---|---|---|---|
| B-1 | Reference | 0.066 | 0.34 | 0.006 | 0.021 | 550 | 10.3 |
| B-2 | | | | | | 570 | 10.4 |
| B-3 | | | | | | 630 | 9.7 |
| B-4 | | | | | | 650 | 9.4 |
| B-5 | | | | | | 660 | 9.0 |
| B-6 | | | | | | 690 | 8.4 |
| B-7 | | | | | | 710 | 7.5 |

As can be seen from the results of Example 1, the hot-rolled low-carbon steel strip according to the present invention has a better press-workability, and the surface conditions and appearance of the pressed goods are excellent. The reasons for the excellent properties of the hot-rolled low-carbon steel strip according to the present invention are the fact that it is free from the fine coil break, that its ferrite grain size number is kept below 9, and that its yield elongation can be removed by ordinary temper rolling with a reduction rate of temper rolling of about 1%.

EXAMPLE 2

Steels with the compositions of Specimens C to H of Table 3 were melted in an oxygen top-blown converter, and rolled into 2.3 mm thick steel strips by a hot-strip mill, under the conditions of finishing mill entry end temperatures of 1,055° to 935° C, and coiling temperatures of 625° to 590° C.

Table 3 and FIG. 3 show the relation between the ferrite grain size and the finishing mill entry end temperature for hot-rolled steel strips with chemical composition within the scope of the present invention.

Table 3(a)

| Specimen No. | | Composition, at ladle (Wt.%) Carbon | Manganese | Phosphorus | Sulfur | Aluminum |
|---|---|---|---|---|---|---|
| C-1 | | 0.051 | 0.29 | 0.007 | 0.015 | 0.046 |
| C-2 | | " | " | " | " | " |
| | Invention | | | | | |
| C-3 | | " | " | " | " | " |
| C-4 | | " | " | " | " | " |
| C-5 | | " | " | " | " | " |
| C-6 | Reference | " | " | " | " | " |
| C-7 | | " | " | " | " | " |
| C-8 | | " | " | " | " | " |
| | Reference | | | | | |
| D-1 | | 0.044 | 0.25 | 0.006 | 0.012 | 0.058 |
| D-2 | | " | " | " | " | " |
| D-3 | | " | " | " | " | " |
| E-1 | | 0.081 | 0.36 | 0.008 | 0.018 | 0.004 |
| | Inventor | | | | | |
| E-2 | | " | " | " | " | 0.010** |
| E-3 | | " | " | " | " | 0.025** |
| F-1 | | 0.049 | 0.33 | 0.007 | 0.021 | 0.020 |
| F-2 | | " | " | " | " | " |
| F-3 | | " | " | " | " | " |
| | Reference | | | | | |
| G | | 0.014 | 0.90 | 0.012 | 0.017 | 0.029 |
| H | Invention | 0.110 | 0.31 | 0.009 | 0.016 | 0.052 |

**Aluminum was added in casting die.

Table 3(b)

| Specimen No. | | Composition, at ladle (Wt. %) Boron* | Nitrogen* | B/N | Hot strip finishing mill entry end temperature (° C) | JIS, Micro-grain size No. |
|---|---|---|---|---|---|---|
| C-1 | | 0.0039 | 0.0048 | 0.81 | 1055 | 8.1 |
| C-2 | | 0.0037 | 0.0049 | 0.76 | 1025 | 7.9 |
| | Invention | | | | | |
| C-3 | | 0.0040 | 0.0052 | 0.77 | 1010 | 8.5 |
| C-4 | | 0.0041 | 0.0052 | 0.79 | 970 | 8.6 |
| C-5 | | 0.0036 | 0.0048 | 0.75 | +945 | 9.5 |
| C-6 | Reference | 0.0038 | 0.0048 | 0.79 | +935 | 9.8 |
| C-7 | | 0.0038 | 0.0053 | 0.72 | +940 | 9.9 |
| | | *** | | | | |
| C-8 | Reference | +0.0110 | 0.0044 | 2.50 | 990 | 9.2 |
| D-1 | | 0.008 | 0.0040 | +0.20 | 1030 | 9.4 |
| D-2 | | 0.0015 | 0.0047 | 0.32 | 990 | 7.9 |
| D-3 | | 0.0023 | 0.0048 | 0.48 | 990 | 7.6 |
| E-1 | Invention | 0.0038 | 0.0045 | 0.84 | 995 | 8.0 |
| E-2 | | 0.0037 | 0.0049 | 0.76 | 1010 | 7.9 |
| E-3 | | 0.0041 | 0.0051 | 0.80 | 955 | 8.8 |
| | | | **** | | | |
| F-1 | | 0.0031 | 0.0088 | 0.35 | 980 | 8.1 |
| | | | **** | | | |
| F-2 | | 0.0025 | 0.0090 | +0.28 | 1020 | 9.5. |
| | | | **** | | | |
| F-3 | Reference | 0.0037 | +0.0113 | 0.32 | 1025 | 9.6 |
| G | | 0.0036 | 0.0054 | 0.67 | 1010 | 9.2 |
| H | Invention | 0.0049 | 0.0053 | 0.92 | 1000 | 8.8 |

*Analysis of samples from casting die.
***Boron was added in casting die.
****Manganese nitride was added in ladle.
+Outside the scope of the invention.

Figure 4A:
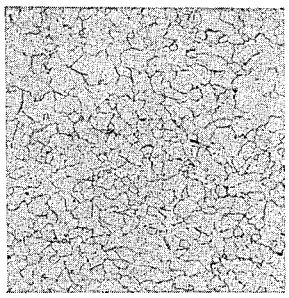
FIGS. 4A and 4B are microscopic views illustrating the ferrite structures of a hot-rolled steel strip according to the present invention and an aluminum-killed steel strip, respectively.
Figure 4B:
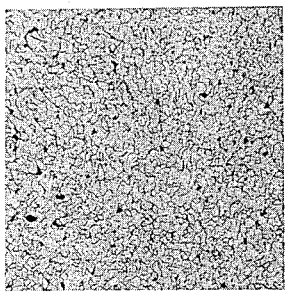

The ferrite structure of a typical steel strip according to the present invention, i.e., Specimen C-2, is shown in FIG. 4A. For comparison, FIG. 4B shows similar ferrite structure of an aluminum-killed steel i.e., Specimen A-5.

The inventors have further found out that a structure having fine spheroidal carbide grains dispersed therein can be achieved by suitably selecting the amount of carbon and the B(%)/C(%) ratio. The drawability and stretch-flangeability of the steel strip of the present invention can be improved without sacrificing the aforesaid press-workability thereof by making carbide in the steel strip into small spheroidal particles dispersed therein while keeping the micro-grain size of the ferrite within No. 7 to 9.

With hot-rolled low-carbon steel strip, it is well known that carbide in the steel structure is a source of fracture during press work, and that the influence becomes greater as the particle size of the carbide increases. Among various factors relating to press work, the elongation of sheared edge and the stretch-flanging are most sensitive to the presence of carbide. More particularly, when steel plate edge having a work-hardened layer caused by shearing is subjected to stretch-flanging, if coarse carbide is present in the steel sheet edge, such carbides provide passage for propagation of minute cracks formed in the work-hardened layer. As a result, the steel plate is cracked at a comparatively low degree of pressing or shaping.

Figure 5:
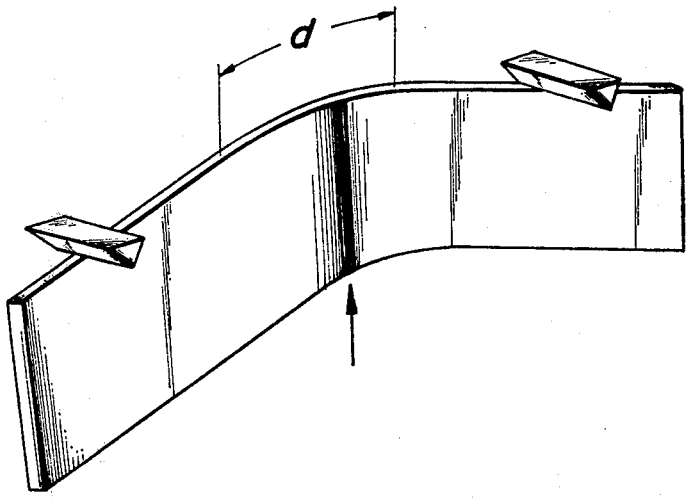
FIG. 5 is a perspective view of a specimen for side bending test.

To assess the stretch-flangeability of metal plates, neither a conventional tensile test using test-pieces with machined edges or conventional bending test checking the resistivity to the occurrence of cracks on the plate surface is effective because the conditions for these conventional tests do not represent the actual press conditions for stretch-flanging. A testing method is proposed, which is referred to as "the side bend test", for accurately representing the actual stretch-flanging conditions as shown in FIG. 5. Referring to the figure, an elongated rectangular test-piece as cut (40 mm width, 170 mm length) is bent about an axis parallel to the width direction of the test-piece, and the elongation of the outer edge of the thus bent portion of the test-piece is measured. In FIG. 5, the distance *d* between two marked points on the test piece is 50 mm, and the elongation of this distance *d* will be referred to as "percent side bend elongation".

As can be seen from the succeeding example, the "side bend test" provides a good assessment of the effect of different forms of carbide on the stretched-flangeability. The results of such a test provide a good representation of the results of actual press work.

As a means for controlling the form of carbide in the hot-rolled low-carbon steel strip, a method is known which consists of quick cooling from the austenite phase and annealing in a temperature range of ferrite phase along. Such known method is, however, very costly. Accordingly, at the present, practically all hot-rolled low-carbon steel strips contain coarse carbide. In conventional methods for controlling the ferrite grain size of thin steel sheet and spheroidization of carbide, two treatments, i.e., cold-rolling and annealing, are necessary.

On the other hand, the present invention has succeeded in providing the aforesaid properties of cold-rolled steel strip by hot-rolling alone for the first time in the industry.

With the present invention, boron is added for controlling the micro-grain size of ferrite in a range from No. 7 to No. 9. The boron thus added is also effective in spheroidizing and dispersing carbides as they precipitate in the steel strip from the solid solution state in the austenite phase. As a result, the carbide is made harmless for press work.

For the purposes of spheroidizing and dispersing carbides, the carbon content in the steel strip of the present invention is limited to be up to 0.10 wt.%, while retaining the aforesaid nitrogen content up to 0.01 wt.%. The reason for this limitation is the fact that the contents of carbon and nitrogen in excess of such range do not ensure the spheroidization and dispersion of carbide grains. For the same reason, the B(%)/C(%) ratio should not be smaller than 0.04 in order to achieve the desired spheroidization and disperson of carbides.

If the hot-rolling is carried out at a temperature in a range where ferrite phase is present, mixed grain size is formed which may lead to a rough surface. To prevent this, the temperature at the delivery or outlet end of a finishing mill should be kept above the A3 transformation point of the steel strip. High coiling temperature is effective in increasing the crystal grain size which leads to an improvement of the press-workability of the steel strip. The high coiling temperature, however, generally tends to cause precipitation of coarse carbides which are detrimental to the workability of the steel strip. With the present invention, however, such coarsening of the carbide due to high coiling temperature can be prevented. As a result, the control of the ferrite grain size by the coiling temperature regulation can be fully used.

Table 4 shows the effect of the present invention on the spheroidization and dispersion of carbides by listing the results of etching with 5% picric acid alcohol and the results of the "side bend tests" for the aforesaid steel strip Specimens A-5, B-4, C-2, D-2, E-3, and E-4. The etching tests are to determine the shape and distribution of carbides.

Figure 6A:
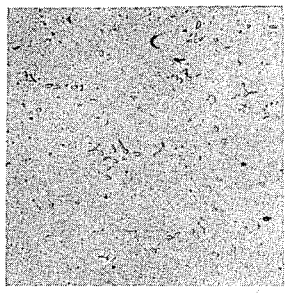
FIGS. 6A and 6B are microscopic views illustrating the carbide structures of a hot-rolled steel strip according to the present invention and an aluminum-killed steel strip, respectively.
Figure 6B:
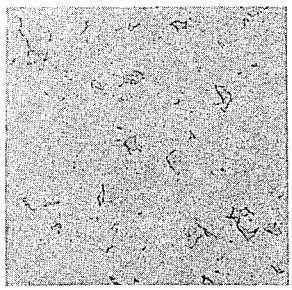

FIGS. 6A and 6B illustrate microscopic pictures of the carbide structures of the hot-rolled steel strip Specimen C-2 and a conventional hot-rolled aluminum-killed steel strip Specimen A-5.

As apparent from Table 4 and FIGS. 6A and 6B, the hot-rolled low-carbon steel strip according to the present invention has a ferrite grain size of No. 7 to No. 9 and its structure includes spheroidal carbides dispersed therein. The results of the side bend test indicate that, as compared with the conventional hot-rolled aluminum-killed steel strip, the boron-containing steel strip according to the present invention has a considerably improved side bend elongation.

Table 4

| Specimen No. | | Composition at ladle (Wt. %) Carbon (C) | Nitrogen (N) | Boron (B) | B/C | JIS, Micro-grain size No. | Shape and distribution of carbide | Percent side bend elonglation (%) L | C |
|---|---|---|---|---|---|---|---|---|---|
| A-5 | Reference aluminum-killed steel | 0.037 | 0.0049 | — | — | 10.0 | Congregated coarse carbide | 60 | 48 |
| B-4 | Reference rimmed steel | 0.066 | 0.0018 | — | — | 9.4 | | 58 | 35 |
| C-2 | | 0.051 | 0.0049 | 0.0037 | 0.073 | 7.4 | Dispersed fine spheroidal carbide | 71 | 70 |
| D-2* | Invention | 0.044 | 0.0047 | 0.0015 | 0.034* | 7.9 | Congregated coarse carbide | 63 | 38 |
| E-3 | | 0.081 | 0.0051 | 0.0041 | 0.051 | 8.8 | Dispersed fine spheroidal carbide | 67 | 65 |
| H* | | 0.110* | 0.0053 | 0.0049 | 0.045 | 8.8 | Mixture of coarse and fine | | |

Table 4-continued

| Specimen No. | Composition at ladle (Wt. %) Carbon (C) | Nitrogen (N) | Boron (B) | B/C | JIS, Micro-grain size No. | Shape and distribution of carbide | Percent side bend elonglation (%) L | C |
|---|---|---|---|---|---|---|---|---|
| | | | | | | carbide | 60 | 45 |

*Outside of the composition for fine carbide according to the invention.

With the hot-rolled low-carbon steel strip according to the present invention, its press-workability can be further improved by limiting the carbon content to a very low level of up to 0.03 wt.% for enhancing the action of boron in the steel. If such very low carbon steel strip is treated by vacuum degassing, a very high press-workability can be achieved together with very low occurrence of orange peel.

In order to reduce the carbon content to the aforesaid very low level of up to 0.03 wt.% without increasing other impurities which are detrimental to press-workability, carbon removal by vacuum degassing is indispensable. Such very low carbon content is necessary not only for improving the press-workability in general, but also for controlling the ferrite grain size and further enhancing the spheroidization and disperson of carbide grains. The contents of both nitroen and boron should not be greater than 0.01 wt.%, respectively. Ratios of B(%)/C(%) and B(%)/N(%) should not be smaller than 0.04 and 0.3, respectively. It has been found that the composition outside such restrictions considerably weaken the ferrite grain size controlling action.

With such boron-containing steel strip having a very low carbon content, the temperature at the delivery or outlet end of a finishing mill can be reduced by about 20° C without causing any excessively large crystal grains as compared with the corresponding temperature which is required for conventional boron-free steel strips as can be seen from the succeeding example. This is important because careful control of the temperature at the finishing mill delivery end in the case of the conventional boron-free, very low carbon steel strip, and much effort has been actually made for keeping the temperature exactly in a required range. The A3 transformation point of very low carbon steel becomes higher as its carbon content decreases, and its rolling temperature must be raised accordingly. The need of a high slab heating temperature and minimization of temperature drop in the hot-rolling operation have made the conventional rolling of very low carbon steel highly complicated. Such rolling conditions of the conventional very low carbon steel are costly to achieve, yet susceptible to a comparatively high rate of scale defects on the steel surface.

The aforesaid reduction of the rolling temperature of very low carbon steel without causing any excessively large crystal grains is ascribable primarily to the lowering of the A3 transformation point of such steel. The A3 transformation during the rolling involves working in austenite phase so that it is different from ordinary static transformations in this respect. Boron has been known as an element which can reduce the static A3 transformation point. What the inventors have found is the fact that boron is also effective in suppressing excessive growth of ferrite grains during hot rolling, and such finding has a special industrial significance because it can considerably remove the burden of carefully controlling the finishing mill delivery and temperature.

In short, the inventors have succeeded in simultaneously achieving the following three effects by adding boron in very low carbon steel at proper ratios with nitrogen and carbon; namely, the outstanding ferrite grain size controlling effect of boron, the carbide spheroidizing effect, and the effect of suppressing excessive growth of ferrite grains.

EXAMPLE 3

Ordinary low-carbon steel was melted in an oxygen topblown furnace, and carbon removal was effected on the melt by vacuum degassing so as to achieve the compositions at ladle as shown in Table 5. Five ingot specimens I-1 to I-5 having 0.005 wt.% of boron were made by adding ferro-boron when pouring the melt in a casting die. Separately, five ingots of Specimens I-6 to I-7 were made without adding boron therein. Those Specimens were separately rolled into 230 mm thick slabs, and further rolled into 2.3 mm thick steel strips in a hot strip mill under the conditions as shown in Table 5. Then, the Specimens were subjected to temper rolling at a reduction rate of 1%.

Test pieces were taken from hot-rolled coils thus made for carrying out tensile tests, side bend tests, hydraulic bulge tests, and inspection of orange peels. The results are shown in Table 5.

As apparent from Table 5, the hot-rolled low-carbon steel strip according to the present invention has a high press-workability and a low occurence of orange peel, as compared with conventional aluminum-killed low-carbon steel.

Table 5(a)

| Specimen No. | | Composition, at ladle before vacuum degassing (Wt. %) Carbon | Manganese | Phosphorus | Sulfur | Nitrogen (N) | Aluminum | Boron (B) |
|---|---|---|---|---|---|---|---|---|
| I-1 | Invention | 0.031 | 0.31 | 0.008 | 0.011 | 0.0019 | — | — |
| I-2 | | | | | | | | |
| I-3 | | | | | | | | |
| I-4 | | | | | | | | |
| I-5 | | | | | | | | |
| I-6 | Aluminum-killed | | | | | | | |
| I-7 | | | | | | | | |
| I-8 | | | | | | | | |

Table 5(a)-continued

| Specimen No. | | Composition, at ladle before vacuum degassing (Wt. %) Carbon | Manganese | Phosphorus | Sulfur | Nitrogen (N) | Aluminum | Boron (B) |
|---|---|---|---|---|---|---|---|---|
| I-9 | steel, | | | | | | | |
| I-10 | Reference | | | | | | | |
| +A-2 | Reference | | | | | | | |

+Outside of the scope of the invention.

Table 5(b)

| Specimen No. | | Composition, at ladle after vacuum degassing (Wt. %) Carbon | Manganese | Phosphorus | Sulfur | Nitrogen* (N) | Aluminum | Boron* (B) |
|---|---|---|---|---|---|---|---|---|
| I-1 | | 0.002 | 0.34 | 0.010 | 0.010 | 0.0061 | 0.040 | 0.0049 |
| I-2 | | | | | | 0.0064 | | 0.0047 |
| I-3 | Invention | | | | | 0.0064 | | 0.0052 |
| I-4 | | | | | | 0.0066 | | 0.0047 |
| I-5 | | | | | | 0.0067 | | 0.0050 |
| I-6 | | | | | | 0.0059 | | — |
| I-7 | Aluminum- | | | | | 0.0063 | | — |
| I-8 | killed | | | | | 0.0058 | | — |
| I-9 | steel, | | | | | 0.0060 | | — |
| I-10 | Reference | | | | | 0.0061 | | — |
| +A-2 | Reference | 0.037 | 0.25 | 0.008 | 0.013 | 0.0046 | 0.051 | 0.0051 |

+Outside of the scope of the invention.
*As determined by bomb sampling from casting die.

Table 5(c)

| Specimen No. | | B/C | B/N | Hot strip finishing mill entry end temperature (° C) | Hot strip finishing mill delivery end temperature (° C) | Coiling temperature (° C) |
|---|---|---|---|---|---|---|
| I-1 | | 2.5 | 0.81 | 1000 | 870 | 620 |
| I-2 | | 2.4 | 0.74 | 990 | 865 | " |
| I-3 | Invention | 2.6 | 0.81 | 1010 | 855 | " |
| I-4 | | 2.4 | 0.71 | 1060 | 890 | " |
| I-5 | | 2.5 | 0.75 | 1020 | 875 | " |
| I-6 | | — | — | 1030 | 860 | " |
| I-7 | Aluminum | — | — | 1005 | 870 | " |
| I-8 | killed | — | — | 1050 | 880 | " |
| I-9 | steel, | — | — | 1030 | 885 | " |
| I-10 | Reference | — | — | 1050 | 900 | " |
| +A-2 | Reference | 1.38 | 1.11 | 1020 | 860 | " |

+Outside of the scope of the invention.

Table 5(d)

| Specimen No. | | JIS,** Micro-grain size No. | Yield point (Kg/mm²) | Tensile strength (Kg/mm²) | Total elongation (%) | Side bend elongation (%) L | C | Formation*** of orange peel |
|---|---|---|---|---|---|---|---|---|
| I-1 | | 7.4 | 17.8 | 31.9 | 49 | 81 | 79 | A |
| I-2 | | 7.8 | 20.0 | 32.1 | 49 | 78 | 78 | A |
| I-3 | Invention | 7.7 | 20.7 | 32.5 | 48 | 80 | 76 | A |
| I-4 | | 7.2 | 17.5 | 32.0 | 49 | 76 | 77 | A |
| I-5 | | 7.5 | 19.9 | 32.9 | 50 | 79 | 75 | A |
| I-6 | | 9.6 | 25.0 | 34.1 | 46 | 62 | 57 | C |
| I-7 | Aluminum- | 9.7 | 27.3 | 34.9 | 45 | 66 | 60 | C |
| I-8 | killed | 9.3 | 26.5 | 33.6 | 46 | 65 | 59 | B |
| I-9 | steel, | 9.4 | 25.4 | 33.2 | 47 | 66 | 61 | A |
| I-10 | Reference | 9.0 | 24.4 | 33.0 | 47 | 68 | 63 | A |

Table 5(d)-continued

| Specimen No. | | JIS,** Micro-grain size No. | Yield point (Kg/mm²) | Tensile strength (Kg/mm²) | Total elonga-tion (%) | Side bend elongation (%) L | Side bend elongation (%) C | Forma-*** tion of orange peel |
|---|---|---|---|---|---|---|---|---|
| +A-2 | Reference | 8.5 | 23.1 | 33.3 | 47 | 72 | 68 | C |

+Outside of the scope of the invention.
**Ferrite grain size number at the central portion of the strip thickness.
***A: No orange peel generated,
B: Some orange peel generated,
C: Much orange peel generated.

As described in the foregoing disclosure, according to the present invention, there is provided hot-rolled low-carbon steel strip which has high press-workability and which is hard to cause stretcher strain and fine coil break for ensuring smooth surface upon pressing. Thus, the hot-rolled low-carbon steel strip according to the present invention is suitable for applications where coating is necessary after pressing, such as metal plating and painting.

What is claimed is:

1. Hot-rolled low-carbon deoxidized steel strip having a smooth pressed surface produced by hot-rolling a low carbon deoxidized steel in a hot-strip mill while maintaining the temperature at the entry end of the hot-strip mill above 950° C and the temperature at the delivery end above the A3 transformation point of the steel to form hot-rolled steel strip, said steel consisting essentially of up to 0.12% by weight of carbon, up to 0.01% by weight of nitrogen, up to 0.0094% by weight of boron, and balance iron, the ratio of the boron content in percent by weight to the nitrogen content in percent by weight being 0.3 to 0.94, said hot-rolled steel strip having a ferrite grain size number, JIS, of 7 to 9, and press forming the steel strip after hot-rolling to form said smooth pressed surface without cold-rolling or annealing said steel strip.

2. Hot-rolled low-carbon deoxidized steel strip according to claim 1 wherein the carbon content is up to 0.10% by weight and the ratio of the boron content in percent by weight to the carbon content in percent by weight is not smaller than 0.04, and the steel strip has a structure of dispersion of spheroidal carbide.

3. Hot-rolled low-carbon deoxidized steel strip according to claim 1 wherein the carbon content is up to 0.03% by weight, the ratio of the boron content in percent by weight to the carbon content in percent by weight is not smaller than 0.04, and the steel strip is free from coarse carbides.

4. Hot-rolled low-carbon deoxidized steel strip according to claim 1 and further including up to 1.20% by weight of manganese and up to 0.03% by weight of sulfur, the ratio of the manganese content in percent by weight to the sulfur content in percent by weight being greater than 10.

5. Hot-rolled low-carbon deoxidized steel strip according to claim 1 and further including up to 0.03% by weight of sulfur and up to 0.03% by weight of phosphorus.

6. Hot-rolled low-carbon deoxidized steel strip according to claim 2 and further including up to 0.03% by weight of sulfur and up to 0.03% by weight of phosphorus.

7. Hot-rolled low-carbon deoxidized steel strip according to claim 3 and further including up to 0.03% by weight of sulfur and up to 0.03% by weight of phosphorus.

8. Hot-rolled low-carbon deoxidized steel strip according to claim 1 and further including as a deoxidizer up to 0.5 wt.% silicon, up to 0.1 wt.% aluminum, up to 0.05 wt.% titanium, 0.05 wt.% zirconium or mixtures thereof.

9. Hot-rolled low-carbon deoxidized steel strip according to claim 2 and further including as a deoxidizer up to 0.5 wt.% silicon, up to 0.1 wt.% aluminum, up to 0.05 wt.% titanium, 0.05 wt.% zirconium or mixtures thereof.

10. Hot-rolled low-carbon deoxidized steel strip according to claim 3 and further including as a deoxidizer up to 0.5 wt.% silicon, up to 0.1 wt.% aluminum, up to 0.05 wt.% titanium, 0.05 wt.% zirconium or mixtures thereof.

11. Hot-rolled low-carbon deoxidized steel strip according to claim 4 and further including as a deoxidizer up to 0.5 wt.% silicon, up to 0.1 wt.% aluminum, up to 0.05 wt.% titanium, 0.05 wt.% zirconium or mixtures thereof.

12. A process of manufacturing hot-rolled low-carbon deoxidized steel strip having a smooth pressed surface without cold-rolling or annealing the steel strip after hot-rolling comprising hot-rolling a low-carbon deoxidized steel in a hot-strip mill while maintaining the temperature at the entry end of the hot strip mill above 950° C and the temperature at the delivery end above the A3 transformation point of the steel so as to produce hot-rolled steel strip having a ferrite grain size number, JIS, between 7 and 9, said steel consisting essentially of up to 0.12% by weight of carbon, up to 0.01% by weight nitrogen, up to 0.01% by weight of boron, and balance iron, the ratio of the boron content in percent by weight to the nitrogen content in percent by weight to the nitrogen content in percent by weight being 0.3 to 0.94, and press forming the steel strip after hot-rolling to form said smooth pressed surface without cold-rolling or annealing said steel strip.

13. A process according to claim 12 wherein said steel further contains up to 0.03% by weight of sulfur and up to 0.03% by weight of phosphorus.

14. A process according to claim 12 wherein said carbon content in said steel is up to 0.10% by weight.

15. A process according to claim 12 wherein said carbon content in said steel is up to 0.03% by weight.

16. A process according to claim 12 wherein said steel further contains as a deoxidizer up to 0.5 wt.% silicon, up to 0.1 wt.% aluminum, up to 0.05 wt.% titanium, 0.05 wt.% zirconium or mixtures thereof.

17. An automobile bumper made of hot-rolled low-carbon deoxidized steel strip having a smooth pressed surface produced by hot-rolling a low-carbon deoxidized steel in a hot-strip mill while maintaining the temperature at the entry end of the hot-strip mill above 950° C and the temperature at the delivery end above the A3 transformation point of the steel to form hot-rolled steel strip, said steel consisting essentially of up to 0.12% by weight of carbon, up to 0.01% by weight of nitrogen, up to 0.01% by weight of boron, and balance iron, the ratio of the boron content in percent by weight to the nitrogen content in percent by weight being 0.3 to 0.94, said hot-rolled steel strip having a ferrite grain size number, JIS, of 7 to 9, and press forming the steel strip after hot-rolling to form said smooth pressed surface without cold-rolling or annealing said steel strip.

* * * * *